US011365080B2

(12) United States Patent
Beale et al.

(10) Patent No.: US 11,365,080 B2
(45) Date of Patent: Jun. 21, 2022

(54) GIMBALED MONOCLAMPS

(71) Applicant: Hewlett-Packard Development Company, L.P., Spring, TX (US)

(72) Inventors: Robert Scott Beale, Vancouver, WA (US); Robert Yraceburu, Vancouver, WA (US); Elliott Downing, Vancouver, WA (US); Matthew Douglas Reier, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 41 days.

(21) Appl. No.: 16/643,309

(22) PCT Filed: Sep. 12, 2017

(86) PCT No.: PCT/US2017/051119

§ 371 (c)(1),
(2) Date: Feb. 28, 2020

(87) PCT Pub. No.: WO2019/054985

PCT Pub. Date: Mar. 21, 2019

(65) Prior Publication Data

US 2020/0346886 A1 Nov. 5, 2020

(51) Int. Cl.

| | |
|---|---|
| ***B65H 31/02*** | (2006.01) |
| ***B65H 29/10*** | (2006.01) |
| ***B65H 31/26*** | (2006.01) |

(52) U.S. Cl.

CPC ..... *B65H 29/10* (2013.01); *B65H 31/02* (2013.01); *B65H 31/26* (2013.01); *B65H 2301/4212* (2013.01); *B65H 2701/1311* (2013.01); *B65H 2701/1313* (2013.01)

(58) Field of Classification Search

CPC ..... B65H 29/10; B65H 31/02; B65H 31/26; B65H 2301/4212; B65H 2701/1311; B65H 2701/1313; B41J 13/00; B41J 13/26; B41J 13/10; B41J 13/22; B41J 13/24

See application file for complete search history.

(56) References Cited

U.S. PATENT DOCUMENTS

| | | | | |
|---|---|---|---|---|
| 3,345,063 A * | 10/1967 | Swanson | B65H 31/34 271/133 |
| 3,575,099 A * | 4/1971 | Levenson | G03C 3/003 396/633 |
| 5,188,353 A * | 2/1993 | Parks | B65H 31/34 271/184 |
| 6,168,154 B1 * | 1/2001 | Asahara | B42C 1/12 270/58.12 |

(Continued)

FOREIGN PATENT DOCUMENTS

WO WO-2017099741 A1 6/2017

*Primary Examiner* — Thomas A Morrison
(74) *Attorney, Agent, or Firm* — Brooks Cameron & Huebsch PLLC

(57) ABSTRACT

In some examples, a gimbaled monoclamp can include a housing including a first opening, a second opening, and a pivot point, a clamp disposed at least partially in the housing and including a first pad and a second pad to extend through the first opening and the second opening, respectively, and a pin extending through an opening in the clamp into the pivot point to couple the clamp to the housing in a gimbaled manner.

15 Claims, 5 Drawing Sheets

(56) References Cited

U.S. PATENT DOCUMENTS

| | | | | |
|---|---|---|---|---|
| 6,568,674 | B2 * | 5/2003 | Matsuda | B65H 3/0669 271/274 |
| 6,819,906 | B1 | 11/2004 | Herrmann et al. | |
| 7,370,858 | B2 * | 5/2008 | Youn | B65H 3/0684 271/121 |
| 8,167,294 | B2 * | 5/2012 | Yahata | B65H 31/36 270/58.27 |
| 8,517,368 | B1 | 8/2013 | Brundige et al. | |
| 8,967,610 | B2 | 3/2015 | Takashima | |
| 2013/0207333 | A1 | 8/2013 | Brundige | |
| 2015/0166277 | A1 | 6/2015 | Shelhart et al. | |
| 2017/0088369 | A1 | 3/2017 | Adami | |

* cited by examiner

GIMBALED MONOCLAMPS

BACKGROUND

Imaging systems, such as printers, generally include a stacking region for the collection of print medium. The stacking region may be an output region where a user may receive the print medium. Imaging systems may be provided with a finishing mechanism where the print medium may be collected for post processing, such as stapling, three-hole punching, etc. The stacking region may be within the imaging system where the print medium are collected for post processing.

DETAILED DESCRIPTION

Figure 1A:
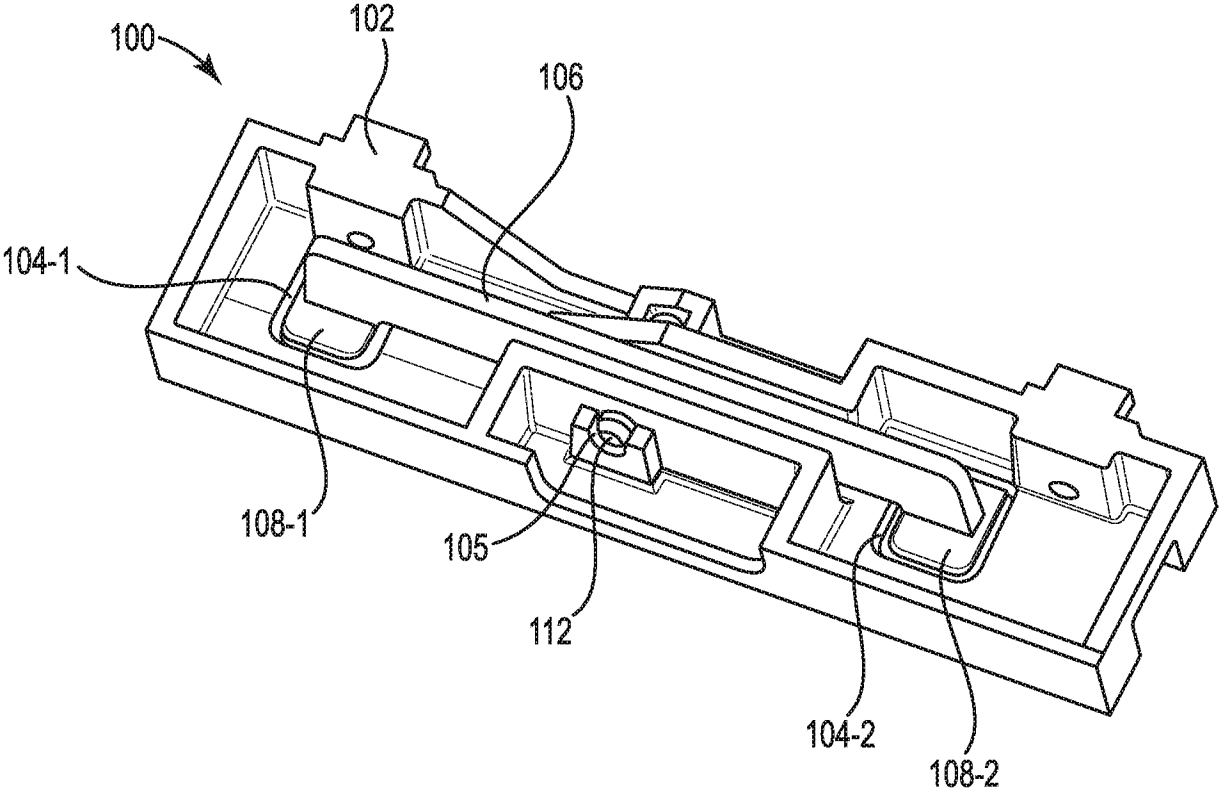
FIG. 1A illustrates a view of an example of a gimbaled monoclamp consistent with the disclosure.

Various examples provide for clamping of print medium, such as a sheet, as it is delivered onto a stacking region which may collect a stack of sheets. The clamping system position may reduce offset between the various print medium in the output stack to facilitate various post-processing functions, such as stapling of the print medium. The clamping system may reduce curling of the edges of the print medium in the stack, as well as reduce air which may be trapped between the print medium.

As described herein, in some examples, print medium may be collected for post processing, such as stapling, three-hole punching. In some cases, such as in inkjet printers where the ink may not be fully dried during stacking, alignment of print medium in a stack may become difficult. For example, the inkjet output print medium may be distorted from curl forming on the edges. Due to the moisture content, the print medium may have reduced stiffness which leads to buckling, and high ink density regions may result in increased friction with adjacent sheets of print medium. The friction can result in misalignment with other sheets of print medium in the stack. Additionally, curling of the sheets of print medium can result in trapped air between the sheets. The trapped air can result in a variety of issues, such as an artificial increase in stack height of sheets of print medium.

Various clamping systems may be provided with trailing edge clamps to clamp a trailing edge of an incoming sheet to the stack and additional clamps in the downstream portion of the stacking region. For instance, in some clamping systems, the clamping arrangements may include two individual clamps. However, use of two individual clamps driven by an individual internal drive train may result in uneven clamping forces between the two individual clamps. For example, a first individual clamp may have forces in the range of 100 grams, while a second individual clamp may have forces in the range of 250 grams. A difference in clamping forces (front/rear force ratio) may be unpredictable and may vary from a unit of a given clamping system to another clamping system (of the same type) and/or from a given clamp activation to a subsequent clamp activation within a given clamping system. Additionally, clamping systems employing the two individual clamps may also employ a dedicated fixture an effort to time the actuation of the two individual clamps relative to each other. However, such dedicated fixtures may fail to properly time the clamps and may thereby reduce an effective travel of the system and/or render an individual clamp ineffective.

Accordingly, the disclosure is directed to gimbaled monoclamps. Desirably, gimbaled monoclamps disclosed herein may decrease the front/rear force ratio and/or eliminate a potential for mistiming, as compared to approaches employing two individual clamps. Specifically, a gimbaled monoclamp may include a monoclamp disposed partially in a housing and including a first pad and a second pad which extend through a first opening and a second opening of the housing. As used herein, a monoclamp refers to a clamp having at least two integral and distinct pads to clamp a print medium. Additionally, the gimbaled monoclamp may include a pin extending through an opening in the clamp into a pivot point to couple the clamp to the housing in a gimbaled manner. As used herein, being gimbaled and a gimbaled manner refer to a pivoted support that allows the rotation of an object about a single axis.

Figure 1B:
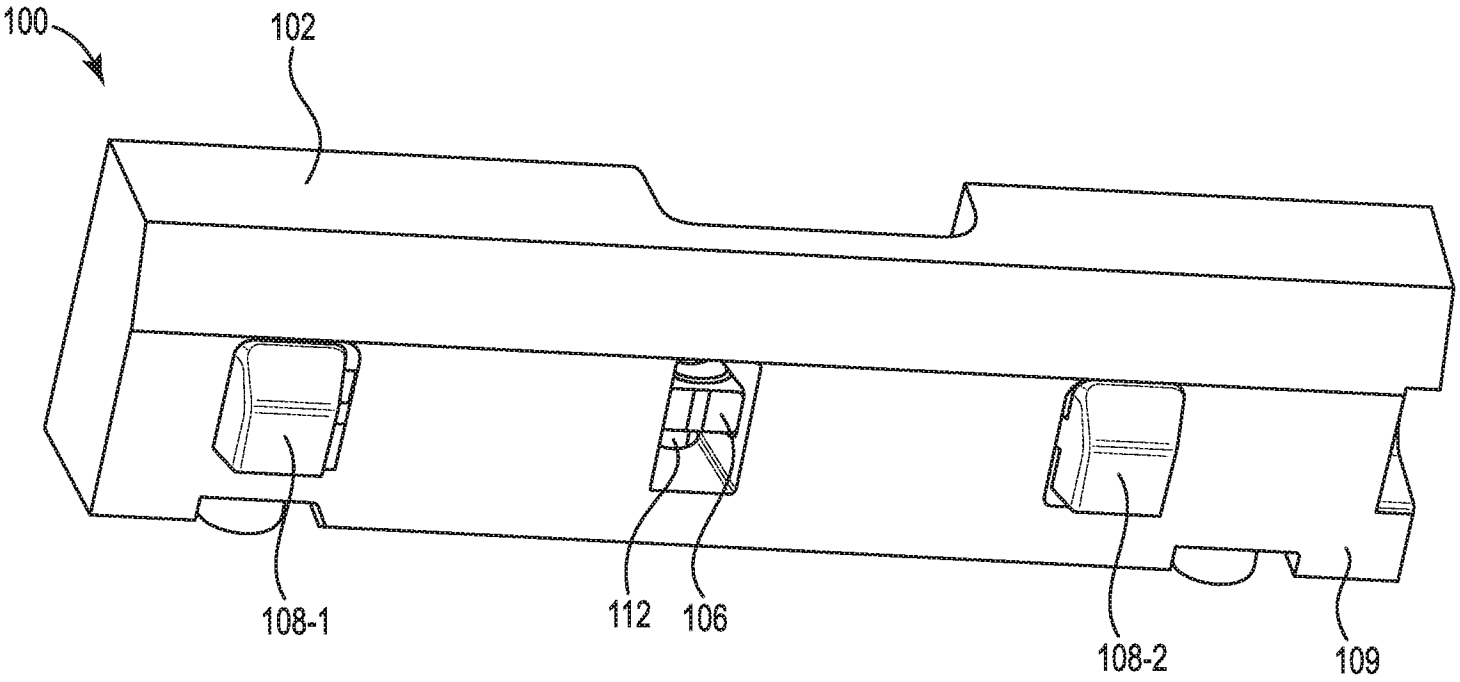
FIG. 1B illustrates another view of an example of gimbaled a monoclamp consistent with the disclosure.

FIGS. 1A-1B illustrates an example of a gimbaled monoclamp 100 in accordance with various examples. The gimbaled monoclamp 100 may comprise a housing 102 including a first opening 104-1, a second opening 104-2, and a pivot point 105. The housing 102 may be formed of a plastic, ceramic and/or metal material. As described herein, the gimbaled monoclamp 100 may be positioned along the width of a platform or stacking region. For example, the gimbaled monoclamp 100 may be positioned downstream of trailing edge clamps (not shown in FIGS. 1A and 1B) along the width of the leading edge portion of a platform or stacking region. The gimbaled monoclamp 100 also may be positioned along the width of the trailing edge portion of the platform or stacking region.

A gimbaled monoclamp system may be sequentially actuated. In some examples, the trailing edge clamps and the gimbaled monoclamp 100 can be sequentially actuated. For example, a controller (not shown in FIGS. 1A and 1B) may activate an advancement mechanism (not shown in FIGS. 1A and 1B) to transport a print medium into the stacking region and actuate the trailing clamp arrangement first and the gimbaled monoclamp second. When the print medium reaches a predetermined point in the stacking region, the controller may actuate the trailing edge clamps to secure the trailing edge of the print medium at the trailing edge portion of the stacking region. The controller may then cause releasing of the advancement mechanism with the trailing edge clamps actuated. Thus, the advancement mechanism may release the print medium while the trailing edge of the print medium is secured in place by the trailing edge clamps.

In some examples, the controller may actuate the gimbaled monoclamp to secure the downstream portion of the print medium. For example, the gimbaled monoclamp 100 may be actuated and lowered to make contact with an incoming sheet. The gimbaled monoclamp 100 may serve to reduce or eliminate curling of the leading edge of the incoming sheet.

In some examples, the controller may actuate the gimbaled monoclamp to secure the trailing edge portion of the print medium. For example, the gimbaled monoclamp 100 may be actuated and lowered to make contact with an incoming sheet. The gimbaled monoclamp 100 may serve to reduce or eliminate curling of the trailing edge of the incoming sheet.

The gimbaled monoclamp 100 may include a housing 102 which may span between a first gear rack and a second gear rack. For example, the housing 102 may span between a front gear and a rear gear rack which is driven by an internal drive train which may be located within a leading edge clamp carrier. The housing 102 may be positioned to allow the rear portion of the housing 102 to interact with the leading edge clamp carrier. As described herein, the housing 102 may be simultaneously secured to both the front gear and the rear gear resulting in a decreased front to rear backlash. The housing 102 being simultaneously secured to both the front gear and the rear gear may minimize the angular variation about the y-axis.

The gimbaled monoclamp 100 may include a housing 102 which may span the width of the platform or stacking region. In some examples, the housing 102 may be secured to a central gear resulting in a decreased front to rear backlash. The housing 102 being secured to a central gear may minimize the angular variation about the y-axis. That is, the central gear can be centrally located along the first axis 101 so the central gear is substantially equidistant from respective distal ends of the housing 102 along the first axis 101 and/or the central gear can be equidistant from the first opening 104-1 and from the second opening 104-2 along the first axis 101.

The first opening 104-1 and the second opening 104-2 may be positioned on the bottom surface 109 along the width of the housing 102. As illustrated in FIG. 1B, the first opening 104-1 may be positioned to allow a first pad 108-1 to extend through the first opening 104-1. As illustrated in FIG. 1B, the second opening 104-2 may be positioned to allow a second pad 108-2 to extend through the second opening 104-2. For example, when the gimbaled monoclamp 100 is actuated and lowered, the housing 102 may travel in a downward motion via an internal drive train (not illustrated). As the housing 102 travels in a downward motion, the first opening 104-1 and the second opening 104-2 may allow the first pad 108-1 and the second pad 108-2 to extend through the bottom surface 109 of the housing 102 to apply clamping forces to the print medium.

The gimbaled monoclamp 100 may comprise a clamp 106 disposed at least partially in the housing 102 and including a first pad 108-1 and a second pad 108-2 to extend through the first opening 104-1 and the second opening 104-2. The clamp 106 may be formed of the same material as the housing 106. The clamp 106 may span between the first opening 104-1 and the second opening 104-2 of the housing 102.

As described herein, the gimbaled monoclamp 100 may travel in a downward motion to secure the downstream portion of the print medium as a sheet enters the stacking region. For example, as the gimbaled monoclamp 100 lowers the first pad 108-1 and/or the second pad 108-2 may make contact with the print medium first. In some examples, while the first pad 108-1 and/or the second pad 108-2 makes contact with the print medium, the housing 102 may continue to travel in a downward motion until the opposite pad, either the first pad 108-1 or the second pad 108-2, makes contact with the print medium to secure the downward portion of the print medium. For example, the housing 102 will continue to travel in a downward motion until both the first pad 108-1 and the second pad 108-2 have made contact with the print medium.

The gimbaled monoclamp 100 may include a pin 112 extending through an opening in the clamp 106 into the pivot point 105 to couple the clamp 106 to the housing 102 in a gimbaled manner. For example, the clamp 106 may be centrally mounted within the housing 102 via the pin 112. The pin 112 may extend through the opening in the clamp 106 into the pivot point 105 to allow the clamp 106 to rotate around the pivot point 105. The pin 112 may be formed of the same material as the clamp 106 and the housing 102 or may be formed of a different material.

In some examples, the clamp 106 may rotate around the pivot point 105 along a first axis 101 to allow the first pad 108-1 to contact the leading edge portion of a platform while the housing 102 travels in a downward motion until the second pad 108-2 contacts the leading edge portion of the platform. In some examples, the clamp 106 may rotate around the pivot point 105 allowing the second pad 108-2 to contact the leading edge portion of the platform while the housing 102 continues in a downward motion until the first pad 108-1 contacts the leading edge portion of the platform. For example, the clamp 106 which may support the first pad 108-1 and the second pad 108-2 may be attached at a central pivot point 105 relative at least to the first axis 101 of the housing 102 and/or the first opening 104-1 and/or the second opening 104-2 to permit the clamp 106 to pivot when contact is made with the leading edge portion of the platform so that the opposite end will also contact the leading edge portion of the platform. That is, the pivot point can be centrally located along the first axis 101 so the pivot point 105 is substantially equidistant from respective distal ends of the housing 102 along the first axis 101 and/or the pivot point 105 can be equidistant from the first opening 104-1 and from the second opening 104-2 along the first axis 101 as illustrated in FIG. 1.

The clamp 106 which may support the first pad 108-1 and the second pad 108-2 may be attached at a non-central pivot point 105 relative at least to the first axis 101 of the housing 102 and/or the first opening 104-1 and/or the second opening 104-2 to permit the clamp 106 to pivot when contact is made with the leading edge portion of the platform so that the opposite end will also contact the leading edge portion of the platform. That is, the pivot point can be non-centrally located along the first axis 101 so the pivot point 105 is unequally distant from respective distal ends of the housing 102 along the first axis 101 and/or the pivot point 105 can be unequally distant from the first opening 104-1 and from the second opening 104-2 along the first axis 101 as illustrated in FIG. 1.

As described herein, the pin 112 can couple the clamp 106 to the housing 102 in a gimbaled manner which may result in the clamping forces being transmitted through the pin to the first pad 108-1 and the second pad 108-2 with even or substantially even distribution while accommodating variance in a relative position of the leading edge portion of the platform in relation to the downward motion of the housing 102. For instance, first pad 108-1 and the second pad 108-2 may contact a print medium with respective forces that are within +/− of 100 grams, within +/− of 50, or within +/− of 10 grams of each other.

Upon the gimbaled monoclamp 100 being actuated and lowered to make contact with the incoming sheet, the housing 102 may then travel in an upward motion to a neutral position. For instance, the housing 102 may travel upward (so not in a position to contact a print medium) prior to an additional sheet entering a stacking region.

As described herein, a first leveling stop and a second leveling stop (not shown in FIG. 1) may be attached to the exterior portion of the leading edge clamp carrier, among other possibilities. The first leveling stop and the second leveling stop may be positioned to interact with the upper portion of the clamp 106 to ensure the clamp 106 returns to the neutral position. For example, as the gimbaled monoclamp 100 travels in an upward and downward motion, the first leveling stop and the second leveling stop may remain in a stationary position above the gimbaled monoclamp 100. As the gimbaled monoclamp 100 lowers, the clamp 106 may rotate around the pivot point 105 to allow the first pad 108-1 and the second pad 108-2 to make contact with the leading edge portion of the platform in a manner that results in a front/rear force ratio ranging from 0.8 to 1.2. This resultant force ratio desirably provides improved clamping and maintenance of the stack position resulting in improved job quality and the minimization of stack theta Z rotation as compared to various other approaches including those that employ two individual clamps.

As mentioned, the housing 102 may travel in an upward motion to a neutral position. As the housing 102 travels in an upward motion, the clamp 106 may continue to rotate around the pivot point 105 until the first leveling stop and the second leveling stop make contact with the clamp 106 at separate points to ensure that the clamp 106 returns to a neutral position. Upon the clamp 106 returning a neutral position the gimbaled monoclamp may repeat the process.

Figure 2:
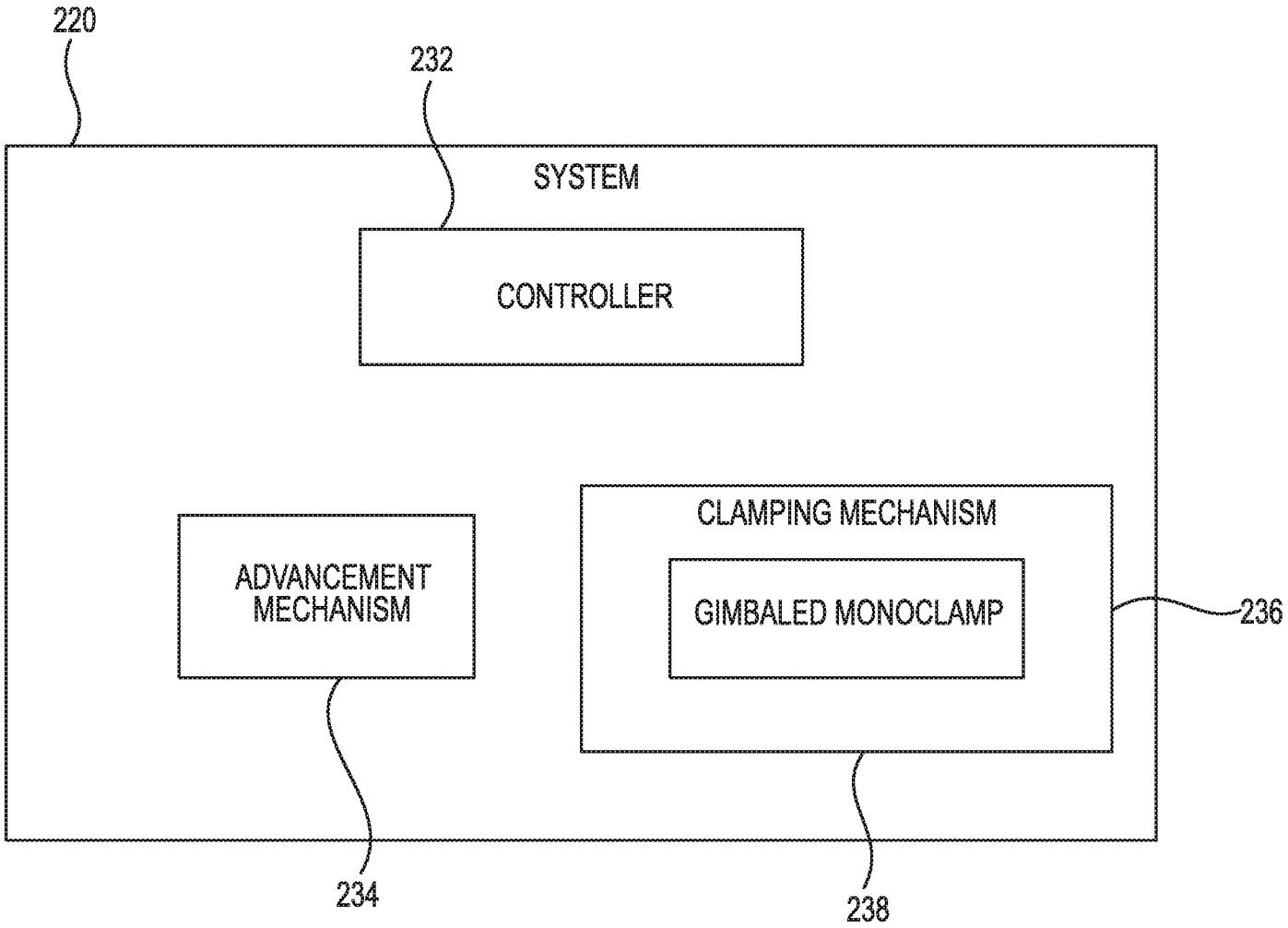
FIG. 2 illustrates an example of a gimbaled monoclamp system consistent with the disclosure.

FIG. 2 illustrates an example of a gimbaled monoclamp system consistent with the disclosure. The system 220 may be implemented in a variety of imaging devices, such as printers or copiers, for example. In some examples, the system 220 of FIG. 2 may be implemented in a finishing portion of an imaging device. The system 220 may include a controller 232 to control operation of various aspects of the system 220. In some examples, the controller 232 may be part of a processor of a larger system, such as an imaging system which contains the system 220 as a finishing portion. The controller 232 of the system 220 may be implemented as hardware such as a processing resource, software (including non-transistory computer readable instructions), and/or firmware, for example.

The system 220 may further include an advancement mechanism 234 to transport print medium into a stacking region. In various examples, the advancement mechanism 234 may include rollers and/or puller clamps which may translate to move the print medium and may, in response, position the advancement mechanism 234 to transport the incoming print medium into the stacking region. Sensors may be used to indicate to the controller 232 that an incoming sheet is in position to be engaged by a puller clamp. Once engaged by the puller clamp, the sheet may be transported toward the stacking region formed by the platform. The trailing edge clamp may be raised prior to the leading edge of the incoming sheet passing the position of the trailing edge clamp.

As the puller clamp transports the incoming sheet further into the stacking region, the middle clamps and the gimbaled monoclamp may be sequentially raised to permit passage of the incoming sheet. Additional clamps, such as corner clamps, may also be sequentially raised to allow the incoming sheet to be transported into the stacking region.

When the incoming sheet is within the stacking region, it may clear guides or channels that may be formed along the medium path, causing the incoming sheet to drop onto the stack. At this point, the incoming sheet may remain engaged by the puller clamp.

The system 220 may include a clamping mechanism 236, comprising a gimbaled monoclamp positioned in the stacking region. For example, the gimbaled monoclamp may be positioned in a downstream portion of the stacking region, the downstream portion being downstream of a trailing edge portion. The clamping mechanism 236 may facilitate alignment of the incoming print medium with other medium that may be in the stacking region. For example, the clamping mechanism 236 may include various features which function to reduce, minimize, or eliminate various issues, such as curling and trapping of air.

The clamping mechanism 236 may also include a trailing edge clamping arrangement positioned in a trailing edge portion of the stacking region. The trailing edge clamping arrangement may include a gimbaled monoclamp and/or at least two clamps. The trailing edge portion of the stacking region may be the area in which the trailing edge of the print medium rests when the print medium are fully transported into the stacking region. The trailing edge of the print medium refers to the portion of a print medium which trails the remainder of that print medium in the direct of transport.

The clamping mechanism 236 may include a gimbaled monoclamp 238. As described herein, the gimbaled monoclamp 238 may be positioned downstream of the trailing edge clamping arrangement and in a downstream portion of the stacking region. The downstream portion of the stacking region may be downstream of the trailing edge portion in the direction of the transport of the print medium. While not shown in FIG. 2, the downstream portion of the stacking region may include additional clamping arrangements.

The system may include a controller 232 to actuate the gimbaled monoclamp 238 when the advancement mechanism 234 transports a print medium into the stacking region. As described herein, the controller 232 may sequentially actuate the trailing edge clamping arrangement and the gimbaled monoclamp 238 as the advancement mechanism 234 transports a print medium into the stacking region. For example, the sequential actuation includes first actuating the trailing edge clamping arrangement and then clamping the gimbaled monoclamp 238.

The sequential actuation of the trailing edge clamping arrangement and the gimbaled monoclamp by the controller 232 may include activating the advancement mechanism 234 to drive the print medium into the stacking region. When the print medium reaches a predetermined point in the stacking region, the controller 232 actuates the trailing edge clamping arrangement to secure the trailing edge of the print medium at the trailing edge portion of the stacking region. The controller 232 then may cause releasing of the advancement mechanism 234 with the trailing edge clamping arrangement actuated. Thus, the advancement mechanism 234 may release the print medium while the trailing edge of the print medium is secured in place by the trailing edge clamping arrangement. The controller 232 may then actuate the gimbaled monoclamp to secure the downstream portion of the print medium.

As described herein, once the incoming sheet has reached a predetermined state, the trailing edge clamp may be actuated and brought into contact with the incoming sheet. For example, the trailing edge clamp may be actuated once the incoming sheet is properly aligned, for example, against a surface on one edge of the incoming sheet. Thus, the trailing edge clamp may serve to hold the incoming sheet in place. In some examples, the trailing edge clamp may function to secure the incoming sheet against movement from a bounce back due to energy stored within the incoming sheet due to buckling against a surface in the stacking region. The trailing edge clamp may reduce curling that may exist in the trailing edge of the incoming sheet.

As described herein, the clamping mechanism arrangement may include a middle clamp. For example, once the incoming sheet is disengaged from the puller clamp, the middle clamp may be actuated and brought down into contact with the incoming sheet and stack. The actuation of the middle clamp may reduce any bumps that may exist in the incoming sheet and the existing stack.

As described herein, the gimbaled monoclamp may be actuated and brought down in contact with the incoming sheet. The gimbaled monoclamp may include a clamp disposed at least partially in a housing, and a first pad and a second pad which extend through a first and second opening of the housing. The gimbaled monoclamp may also include a pin which extends through an opening in the clamp into a pivot point to couple the clamp to the housing in a gimbaled manner. The gimbaled monoclamp may serve to reduce or eliminate curling of the leading edge of the incoming sheet.

As described herein, as the housing travels in an upward and downward motion, a first leveling stop and a second leveling stop may remain in a stationary position above the housing. As the housing lowers, the clamp may rotate around the pivot point allowing the first pad and the second pad to make contact with the leading edge portion of the platform in a manner that results in a front/rear force ratio to range from 0.8 to 1.2. This reduced force ratio may provide improved clamping and maintenance of the stack position resulting in improved job quality and the minimization of stack theta Z rotation.

The housing may travel in an upward motion to a neutral position prior to an additional sheet entering the stacking region. As the housing travels in an upward motion, the clamp may continue to rotate around the pivot point until a first leveling stop and a second leveling stop make contact with the clamp at separate points to ensure that the clamp returns to a neutral position.

The clamping mechanism 236 may include an additional clamp. For example, the clamping mechanism 236 may include corner clamps which may be used to reduce curling of the incoming sheet of the stack. The system 220 may now be ready to receive another incoming sheet and repeat the process.

Figure 3:
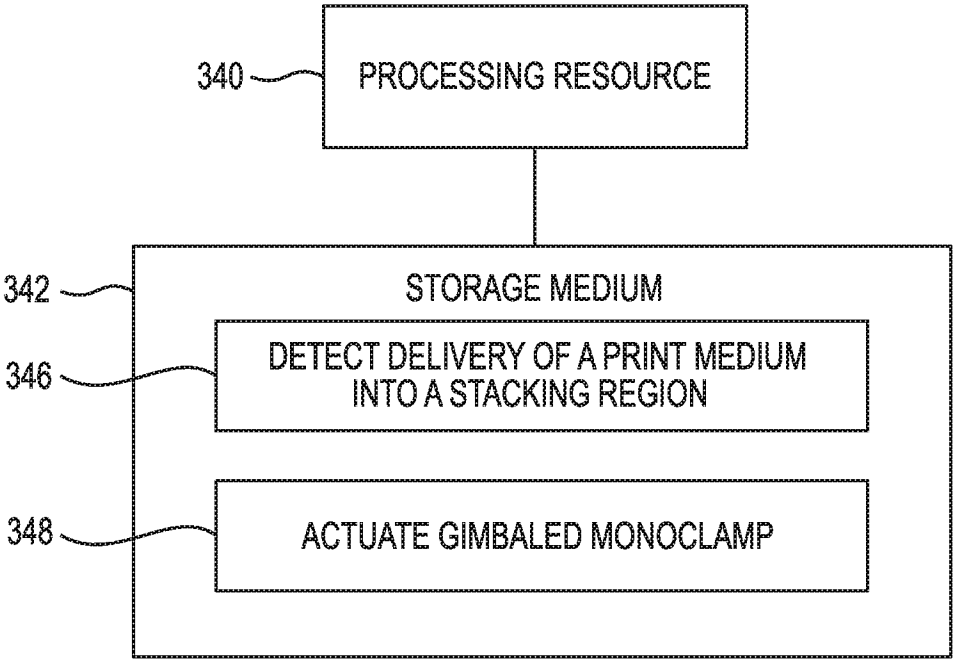
FIG. 3 illustrates a diagram of an example of a non-transitory computer readable medium and processing resource suitable with gimbaled monoclamp consistent with the disclosure.

FIG. 3 illustrates a diagram of an example of a non-transitory computer readable storage medium 342 and processing resource 340 for gimbaled monoclamping consistent with the disclosure. In some examples, the processing resource 340 may process and/or control data received from inputs of an apparatus. A memory resource can be used to store instructions executed by the processing resource 340 to perform operations as described herein. A processing resource 340 may execute instructions stored on the non-transitory machine readable storage medium 342. The non-transitory machine readable medium 342 may be any type of volatile or non-volatile memory or storage, such as random access memory (RAM), flash memory, read-only memory (ROM), storage volumes, a hard disk, or combinations thereof.

Instructions 346, when executed by processing resource 340, may cause the processing resource 340 to detect delivery of a print medium into a stacking region by an advancement mechanism. In some examples, instructions 346 to detect delivery of print medium may further include instructions to engage the print medium with an advancement mechanism, such as a puller clamp, and to advance the print medium into a stacking region.

Instructions, when executed by processing resource 340, may cause the processing resource 340 to actuate a trailing edge clamping arrangement in a trailing edge portion of the stacking region to secure a trailing edge of the print medium. As described herein, when the print medium reaches a predetermined position, a trailing edge clamping arrangement may be actuated to bring trailing edge clamps into contact with the incoming sheet. In some examples, the trailing edge clamping mechanism may be actuated once the incoming sheet is properly aligned, for example, against a surface edge of the incoming sheet.

Instructions, when executed by processing resource 340, may cause the processing resource 340 to release the advancement mechanism with the trailing edge clamping arrangement actuated. As described herein, once the print medium is secured by the trailing edge clamping mechanism, the print medium may be released by the advancement mechanism (e.g., puller clamp).

Instructions 348, when executed by processing resource 340, may cause the processing resource 340 to actuate the gimbaled monoclamp to secure a portion of the print medium in the stacking region. For example, the gimbaled monoclamp may secure a downstream portion of the print medium in the stacking region, among other portions of the print medium. As described herein, the gimbaled monoclamp may include a clamp disposed at least partially in a housing, and a first pad and a second pad which extend through a first and second opening of the housing. The gimbaled monoclamp also may include a pin which extends through an opening in the clamp into a pivot point to couple the clamp to the housing in a gimbaled manner.

As described herein, as the housing lowers the clamp may rotate around the pivot point allowing the first pad and the second pad to make contact with the leading edge portion of the platform in a manner that results in a front/rear force ratio to range from 0.8 to 1.2. This reduced force ratio may provide improved clamping and maintenance of the stack position resulting in improved job quality and the minimization of stack theta Z rotation.

In some examples, instructions 348 to actuate the gimbaled monoclamp to secure a downstream portion of the print medium in the stacking region may further include instructions to actuate additional clamping arrangements to secure a downstream portion of the print medium in the stacking region. For example, additional clamping arrangements may include a middle clamp and/or corner clamps.

Figure 4:
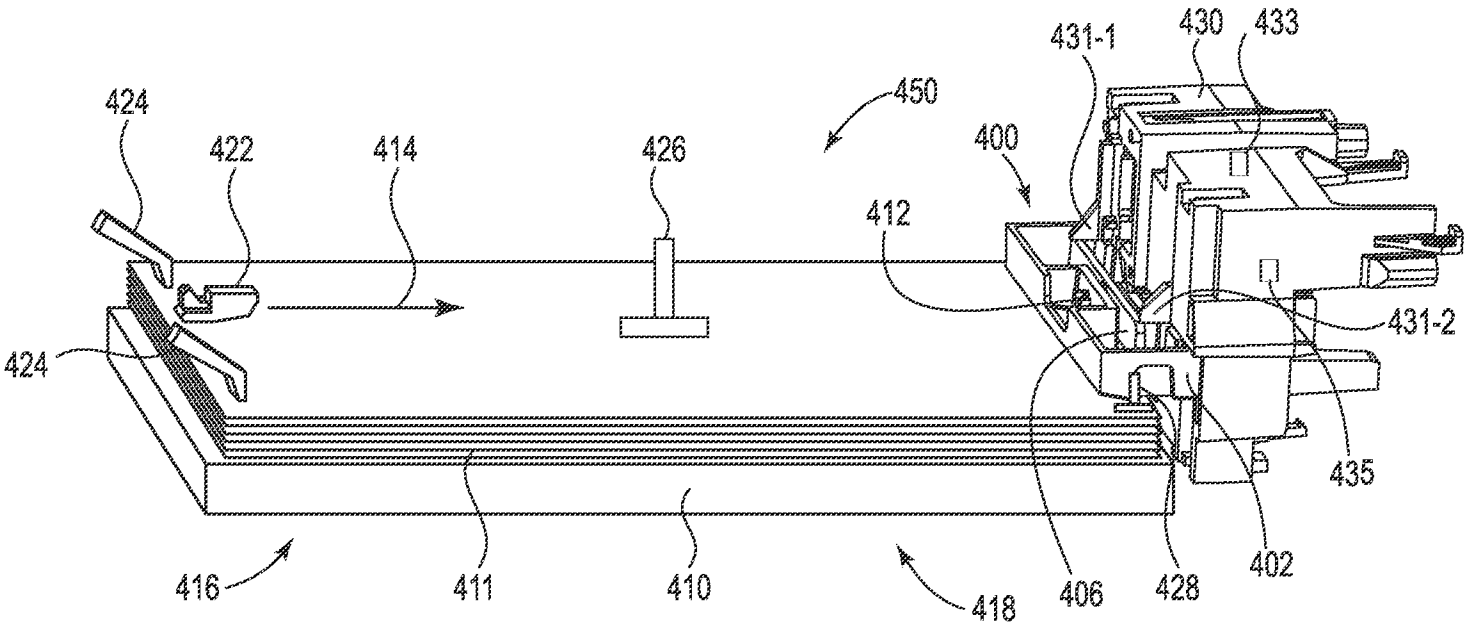
FIG. 4 illustrates an example of a gimbaled monoclamp system consistent with the disclosure.

FIG. 4 illustrates an example of a gimbaled monoclamp system 450 in accordance with various examples. The gimbaled monoclamp system 450 may include an advancement mechanism 422. The advancement mechanism 422 of the gimbaled monoclamp system 450 may be a puller clamp which may engage a leading edge of a print medium (not shown) as the print medium is delivered into the stacking region of the platform 410 from, for example, an image forming portion (not shown). The puller clamp may then translate in the direction of the arrow 414, thus transporting the print medium onto the platform 410 or the stack 412. Various examples of the advancement mechanism 422 (e.g., the puller clamp) may include various components not shown, such as a gearing mechanism, to facilitate operation of the advancement mechanism 422. The advancement mechanism 422 may be controlled by a controller.

The gimbaled monoclamp system 450 may include various clamps to secure an incoming print medium and/or the stack 411, for example, reduce or eliminate curling or trapped air between sheets of the stack 411. In this regard, the example gimbaled monoclamp system 450 can include two trailing edge clamps 424 positioned along the width of the trailing edge portion 416 of the platform 410 or the stacking region. As described herein, the trailing edge clamps 424 may be controlled by a controller (not shown in FIG. 4).

The gimbaled monoclamp system 450 may include a gimbaled monoclamp 400 positioned downstream of the trailing edge clamps 424 along the width of the leading edge portion 418 of the platform 410 or the stacking region. As described herein, the gimbaled monoclamp 400 may be controlled by a controller (not shown in FIG. 4).

As described herein, the gimbaled monoclamp 400 may include a clamp 406 disposed at least partially in a housing 402 and a first pad and a second pad which extend through a first and second opening of the housing 402. The gimbaled monoclamp 400 also may include a pin 412 which extends through an opening in the clamp 406 into a pivot point to couple the clamp 406 to the housing 402 in a gimbaled manner.

As described herein, the housing 402 may be simultaneously secured to both a front gear (as represented by element 333) and a rear gear (as represented by element 335). The front gear 333 and the rear gear 335 may be located within a leading edge clamp carrier 430. Additionally, a first leveling stop 431-1 and a second leveling stop 431-2 may be attached to the exterior portion of the leading edge clamp carrier 430. The first leveling stop 431-1 and the second leveling stop 431-2 may be positioned to interact with the clamp 406 to ensure the clamp 406 returns to a neutral position prior to an additional sheet entering the stacking region.

The gimbaled monoclamps system 450 may include additional clamps positioned downstream of the trailing edge clamps 424. For example, additional clamps positioned downstream of the trailing edge clamps 424 may include a middle clamp 426 and/or corner clamps 428. The middle clamp 426 may be positioned in a central region of the platform 410, for example, substantially at a center of the stacking region. While the example of FIG. 4 is provided with a middle clamp 426, other examples may include middle clamps spread out in a central portion of the platform 410. The corner clamps 428 may be positioned on or near the ends of the width of the leading edge portion of the platform 410 or the stacking region to facilitate reduction or elimination of corner curl in the print medium.

In the foregoing detailed description of the disclosure, reference is made to the accompanying drawings that form a part hereof, and in which is shown by way of illustration how examples of the disclosure may be practiced. These examples are described in sufficient detail to enable those of ordinary skill in the art to practice the examples of this disclosure, and it is to be understood that other examples may be utilized and that process, electrical, and/or structural changes may be made without departing from the scope of the present disclosure.

The figures herein follow a numbering convention in which the first digit corresponds to the drawing figure number and the remaining digits identify an element or component in the drawing. Elements shown in the various figures herein may be capable of being added, exchanged, and/or eliminated so as to provide a number of additional examples of the disclosure. In addition, the proportion and the relative scale of the elements provided in the figures are intended to illustrate the examples of the disclosure, and should not be taken in a limiting sense.

What is claimed:

1. A gimbaled monoclamp, comprising:

a housing including a first opening, a second opening, and a third opening at a pivot point;

a clamp disposed at least partially in the housing to support a first pad and a second pad and travel in a downward motion to transmit a force to a leading edge portion of a platform; the first pad and the second pad to extend through the first opening and the second opening, respectively; and a pin extending through an opening in the clamp into the pivot point to couple the clamp to the housing in a gimbaled manner.

2. The gimbaled monoclamp of claim 1, wherein the housing is secured to both a front gear and a rear gear resulting in decreased front to rear backlash.

3. The gimbaled monoclamp of claim 1, wherein the first opening and second opening are positioned on a bottom surface along a width of the housing.

4. The gimbaled monoclamp of claim 1, wherein the clamp is centrally mounted within the housing along a first axis via the pin.

5. The gimbaled monoclamp of claim 1, wherein the clamp is to rotate around the pivot point along a first axis allowing the first pad to contact the leading edge portion of the platform while the housing travels in a downward motion until the second pad contacts the leading edge portion of the platform.

6. The gimbaled monoclamp of claim 1, wherein the first pad is sized and positioned to contact the leading edge portion of the platform when the second pad contacts the leading edge portion of the platform.

7. A system, comprising:

an advancement mechanism to drive a print medium into a stacking region;

a clamping mechanism, including a gimbaled monoclamp positioned in the stacking region comprising:

a housing including a first opening, a second opening, and a third opening at a pivot point;

a clamp disposed at least partially in the housing to support a first pad and a second pad and travel in a downward motion to transmit a force to a leading edge portion of a platform;

the first pad and the second pad to extend through the first opening and the second opening, respectively; and a pin extending through an opening in the clamp into the pivot point to couple the clamp to the housing in a gimbaled manner; and a controller to actuate the gimbaled monoclamp when the advancement mechanism transports a print medium into the stacking region.

8. The system of claim 7, wherein the clamping mechanism includes a trailing edge clamping arrangement.

9. The system of claim 8, wherein the gimbaled monoclamp is positioned downstream of the trailing edge clamping arrangement.

10. The system of claim 8, wherein the controller is to sequentially actuate the trailing edge clamping arrangement and the gimbaled monoclamp as the advancement mechanism transports the print medium.

11. A non-transitory machine-readable storage medium having stored thereon machine-readable instructions to cause a computing processor to:

detect delivery of a print medium into a stacking region by an advancement mechanism; and actuate a gimbaled monoclamp to secure a portion of the print medium in the stacking region, wherein the gimbaled monoclamp includes a clamp disposed at least partially in a housing to support a first pad and a second pad; and travel in a downward motion to transmit a force from the clamp, through the first pad and the second pad, to a leading edge portion of a platform.

12. The medium of claim 11, wherein the gimbaled monoclamp includes the clamp disposed at least partially in the housing, and the first pad and the second pad which extend through a first opening and a second opening of the housing.

13. The medium of claim 12, wherein the gimbaled monoclamp includes a pin which extends through an opening in the clamp into a pivot point to couple the clamp to the housing in a gimbaled manner.

14. The medium of claim 11, including instructions to:

actuate a trailing edge clamping arrangement in a trailing edge portion of the stacking region to secure a trailing edge of the print medium; and release the advancement mechanism with the trailing edge clamping arrangement actuated.

15. The medium of claim 14, wherein the trailing edge clamping arrangement includes at least two clamps spaced along the width of the trailing edge portion of the stacking region.

* * * * *